United States Patent [19]

Allison et al.

[11] 4,262,760

[45] Apr. 21, 1981

[54] REAMER-STABILIZER

[75] Inventors: Glenn L. Allison; Thomas E. Winship; Daniel B. Justman, all of Houston, Tex.

[73] Assignee: Smith International, Inc., Houston, Tex.

[21] Appl. No.: 34,759

[22] Filed: Apr. 30, 1979

[51] Int. Cl.[3] ..... E21B 10/30; E21B 10/22

[52] U.S. Cl. ..... 175/347; 308/237 R; 175/371

[58] Field of Search ..... 175/344–348, 175/354, 371; 308/4 A, 72, 237 R, 240

[56] References Cited

U.S. PATENT DOCUMENTS

| | | | |
|---|---|---|---|
| 1,174,568 | 3/1916 | Griffin | 175/346 |
| 1,466,137 | 8/1923 | Mead | 308/237 R X |
| 1,669,268 | 5/1928 | Swoyer | 308/237 R X |
| 1,837,423 | 12/1931 | Foster | 175/292 |
| 3,820,613 | 6/1974 | White | 175/337 |
| 3,881,791 | 5/1975 | Hentschel | 308/237 R |
| 4,182,425 | 1/1980 | Garrett | 175/347 |

*Primary Examiner*—James A. Leppink
*Assistant Examiner*—Richard E. Favreau
*Attorney, Agent, or Firm*—Murray Robinson; Ned L. Conley; David Alan Rose

[57] ABSTRACT

A drilling fluid roller reamer-stabilizer includes a tubular body having threaded pin and box connectors at each end adapted to be connected in a drill string and providing a fluid passage connecting the upper part of the drill string with the lower part. Rollers having integral pins at their ends are mounted in pockets in the sides of the body. The pins extend into holes in arcuate cross section bearing blocks received in correlative sockets in the body at the ends of the pockets. Each block makes an interference fit with the sockets in the body. Tool access passages allow a tool to be inserted behind each block to drive or pry it out. Slotted, resilient bearing sleeves are provided in the holes in the blocks where the roller pins are received. The sleeves extend beyond the holes toward the rollers to take axial thrust. Flanges on the ends of the sleeves provide additional thrust area.

4 Claims, 8 Drawing Figures

REAMER-STABILIZER

CROSS REFERENCE TO RELATED APPLICATIONS

This application is an improvement upon the invention disclosed in the prior United States patent application of William R. Garrett, Ser. No. 779,770 filed May 30, 1977, now U.S. Pat. No. 4,182,425, issued Jan. 8, 1980, the disclosure of which is incorporated herein by reference.

Two other applications filed contemporaneously herewith, one by William R. Garrett and one by Glen Allison, both entitled Reamer—Stabilizer, Ser. No. 35,066 filed May 1, 1979 and 34,405 filed Apr. 30, 1979 relate to other improvements upon the invention of the aforementioned Garrett application Ser. No. 799,770.

BACKGROUND OF THE INVENTION

This invention relates to roller reamers useful in the rotary system of earth boring, e.g. for petroleum wells, and more particularly to such reamers in which the rollers are replaceably mounted on the reamer body.

DESCRIPTION OF THE PRIOR ART

According to the aforementioned patent application, a reamer includes a tubular body having a plurality of pockets thereabout to receive the rollers, which are rotatably mounted on shafts, and the ends of the shafts are supported in mounting blocks having sides of arcuate configuration received in correlative pockets in the reamer body, various arrangements being provided to lubricate the roller-shaft areas of relative rotation. A form of this construction similar to that shown in FIG. 9 of the aforementioned application has been built.

Certain prior patent art relative to such construction is discussed in the specification of the aforesaid prior application including U.S. Pat. No. 3,820,613 to White. Further prior art patent references are of record in the file of that application, including a U.S. Pat. to Gray, U.S. Pat. No. 3,907,048.

In the aforementioned Gray patent roller reamer there are no shafts rotatably supporting the roller, and consequently the problems of lubricating the roller-shaft interface are not present. The rollers are rotatably mounted in weld integrated assemblies, each including a tray receiving the roller body and rectangular bearing blocks rotatably receiving pins on the ends of the roller. In such construction, due to the flat sides of the blocks, the whole block-tray-roller assembly is free to move axially relative to the reamer body except as limited by the ends of the blocks abutting the reamer body, unless further securement means such as screws or weldments are employed. To keep the roller-tray-block assemblies from falling radially into the interior of the reamer body through slots in the body's side walls, in which slots the assemblies are mounted, the ends of the slots are provided with shoulders or steps in their side portions. The Gray construction, a relatively light structure, is intended for air drilling, and passages are provided for admitting air from the reamer body to the areas between the pins and the ends of the rollers and the blocks and between the tray and rollers.

A further example of a construction employing gudgeon mounted rollers is shown in U.S. Pat. No. 3,820,613. See also the brochure of Technical Drilling Tools, Inc. dated 1978.

SUMMARY OF THE INVENTION

According to the present invention, there is provided a roller reamer capable of use with high pressure liquid drilling fluid. The reamer body is a continuous tube having a plurality of pockets in its side walls, as in the aforementioned patent application. Arcuate side wall stepped sockets at each end of each pocket receive correlatively shaped blocks with an interference fit, and tool access passages in the sides of the reamer body allow a wedge or other tool to be inserted from outside the reamer body under each block between the block and the part of the reamer body behind or under the block, thereby to enable the blocks to be driven or pried out. The foregoing is all in accordance with the aforementioned prior application.

Further, in accordance with the present invention, each roller is provided at each end with an integral pin which is rotatably mounted in a resilient bearing sleeve disposed in a hole in one of the blocks. Each bearing sleeve makes an interference fit with the hole in the mounting block. Each sleeve is split and resilient to facilitate such fit. The reamer is drilling fluid lubricated. The employment of resilient bearing sleeves is already known in connection with other apparatus, but it is believed to be new to employ same in the present reamer construction.

BRIEF DESCRIPTION OF THE DRAWING

For a detailed description of a preferred embodiment of the invention, reference will now be made to the accompanying scale drawings wherein.

The drawings employ the conventions of the United States Patent & Trademark Office for patent cases relative to the identification of materials, from which it will be seen that the entire reamer is made of metal. Preferably, all parts are made of steel, except that the earth formation reducing means comprising the inserted teeth in the reamer rollers are preferably made of tungsten carbide, and the bearing sleeves are made of a corrosion and wear resistant material such as stainless steel.

DESCRIPTION OF PREFERRED EMBODIMENTS

Figure 1:
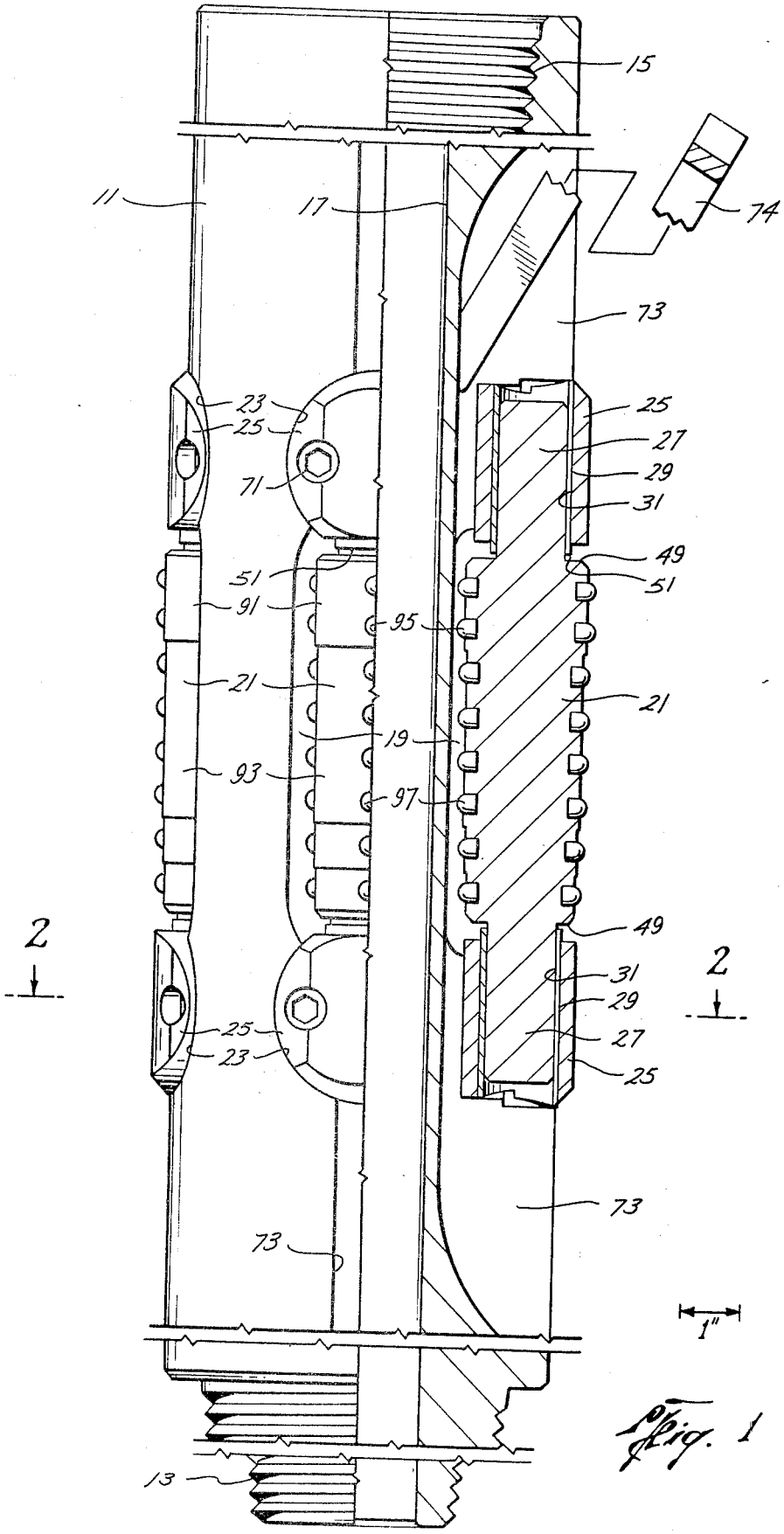
FIG. 1 is a half section showing a reamer embodying the invention.

Referring now to FIG. 1, there is shown a reamer including a tubular body 11 having tool joint type pin and box threaded connectors 13, 15 at its ends, as might be suitable for a reamer used in the drill string some distance above the drill bit. Other forms of threaded connectors, e.g. a box on bottom and a pin or box on top, for use immediately above a drill bit, or other combinations with a pin or box at either end, may be employed as required for connection to adjacent drill string members. There is thus provided an impervious fluid passage 17 through the reamer from the connection 15 at the upper end to the connection 13 at the lower end.

Figure 2:
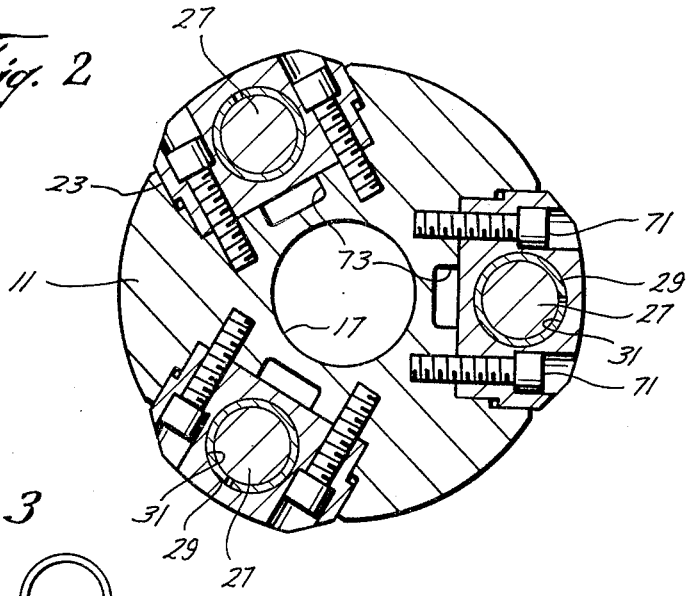
FIG. 2 is a section taken at plane 2—2 of FIG. 1.

Around the outer periphery of the reamer body are a plurality of pockets 19, each adapted to receive one of the rollers 21. FIG. 1 shows the roller pockets as though they were disposed at ninety degrees to each other, thereby to facilitate showing both a straight front view and a sectional view, but preferably there are three pockets disposed 120 degrees apart, as shown in FIG. 2.

At each end of each pocket is a socket 23 of arcuate configuration, as described in the aforementioned patent application, e.g. of stepped cylindric shape.

Within each socket is received, with an interference fit, a bearing block 25 having side walls correlative to those of the sockets. Blocks 25 are flat on their sides adjacent rollers 21. Each roller 21 has a cylindrical pin 27 at each end, rotatably received in a bearing sleeve 29 making an interference fit in a bore or hole 31 in one of the bearing blocks 25.

Figure 3:
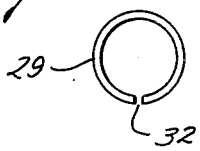
FIGS. 3 and 4 are end and side views of one of the bearing sleeves.
Figure 4:
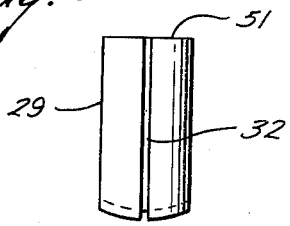

As shown in FIGS. 3 and 4 each bearing sleeve is a simple tube of suitable bearing metal. Each sleeve 29 is made of hard, corrosion resistant, resilient material such as stainless steel, and is split axially, leaving a gap 32 whereby the sleeve can contract radially when forced into a hole in a bearing block. One end of each sleeve has the shape characteristic of the intersection of a cylinder (sleeve 29) and a second cylinder (socket 23) so as to abut the side of socket 23 with full area contact.

Figure 5:
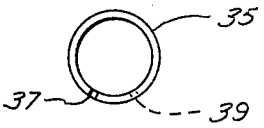
FIGS. 5 and 6 are views similar to FIGS. 3 and 4 showing a modification.
Figure 6:
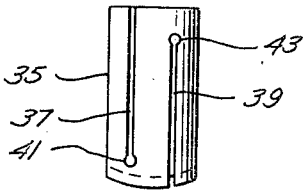

FIGS. 5 and 6 show a modified form of bearing sleeve 35, similar to sleeve 29 except for a pair of slots 37, 39 each running from one end of the sleeve past the midpoint of the sleeve toward the other and terminating in a stress relief fillet 41, 43. The sleeve is thereby weakened sufficiently to facilitate its insertion with an interference fit into one of the mounting blocks without too much difficulty. In other words, the sleeve is converted to an inverted garter spring.

Figure 7:
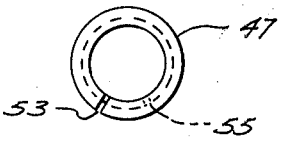
FIGS. 7 and 8 are views similar to FIGS. 5 and 6 showing a further modification.
Figure 8:
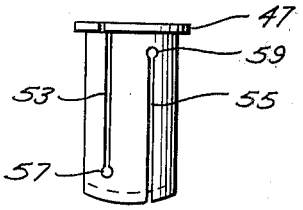

FIGS. 7 and 8 show a further modified bearing sleeve similar to FIGS. 5 and 6 except that a radial flange 47 is provided at the end of the sleeve nearest roller 21. Such flanges provide additional area for taking axial thrust of rollers 21 when contacted by ends 49 as compared to the plain ends 51 of the bearing sleeves shown in FIGS. 1–4. As in the FIGS. 5 and 6 embodiment, the sleeve is provided with slots 53, 55 terminating in fillets 57, 59. Since the slots extend only part way from one end to the other, there remains full circumferential area of sleeve to contact and support the pins on the ends of the rollers.

Referring once more to FIGS. 1 and 2, as in the aforementioned patent application the blocks are provided with cap screws 71 to serve as safety retention means, the screws passing through counter sunk holes in the blocks into threaded holes in the reamer body. When it is desired to replace a roller, the screws are removed. The reamer body is provided with slots 73 which extend underneath the radially inward parts of the bearing blocks so that a tool 74 can be inserted there behind to drive out the blocks by wedge, lever, or percussion action. This is more fully described in the aforementioned patent application.

FIG. 1 shows rollers having larger and smaller diameter cylindrical lands 91, 93 in which are set circumferential rows of tungsten carbide teeth 95, 97, the teeth 95 protruding farther radially than the teeth 97. Other forms of bore hole wall contacting, earth formation reducing means besides 95, 97 could be employed, as more fully described in the aforementioned patent application.

In operation, the reamer is connected in a drill string at a desired level, and as the drill string is rotated in the well bore the reamer rollers cut the earth formation to maintain the hole full gage and to help keep the drill bit and other parts of the drill string centered so as to keep the hole straight.

As the drill string and reamer body rotate in the hole, the rollers, contacting the sides of the well bore, rotate about their own axes, the pins at the ends of the rollers turning in the bearing sleeves, which take the lateral thrust. As the drill string moves, turns, and the rollers rotate, the rollers may also exert end thrust on their bearing sleeves, due to the weight forcing the rollers down, or the sides of an undergage hole causing the rollers to be held up as the drill string descends. Since the pins are free to move axially in the mounting blocks, the roller will shift axially until one end of each roller contacts the end of the adjacent bearing sleeve.

The distance of axial shaft prior to the rollers contacting the ends of the bearing sleeves is less than the axial shift that would be required before ends of the pins strike the sides of the sockets in the reamer body, so the thrust is taken by the ends of the rollers and bearing sleeves rather than between the ends of the pins and the sides of the sockets in the reamer body.

As drilling proceeds, drilling fluid is pumped down the drill string and through fluid passage 17 from the upper end of the reamer body down to the lower end of the body, and then after passing through the drill bit, the drilling fluid returns back of the well bore outside the drill string. As the rising drilling fluid goes upwardly past the outside of the reamer body, it passes through the pockets in the reamer body and clears out the detritus from the pockets. It also lubricates and cools the surfaces at the interface of each roller pin and bearing sleeve.

While preferred embodiments of the invention have been shown and described, modifications thereof can be made by one skilled in the art without departing from the spirit of the invention.

I claim:

1. Apparatus useful in earth boring by the rotary method, comprising:

a tubular body;

thread means at each end of the body for making a rotary shouldered connection with an adjacent drill string member, a plurality of circumferentially spaced, axially alongated pockets in the sides of the body, a plurality of rollers, each disposed in one of said pockets, a plurality of sockets in the sides of the body positioned one at each end of each pocket, each socket opening into the adjacent pocket, a plurality of blocks disposed in each socket, each roller having an integral pin at each end, each pin being rotatably supported in an opening in one of the blocks, each block having a front facing radially outward of said body and a back facing radially inward and a side wall portion making an interference fit with the socket, tool cooperation means carried by the apparatus for cooperation with a tool for forcing out the blocks when it is desired to replace the rollers, said tool cooperation means comprising tool passage means, each providing an opening extending from the outer surface of said body between a socket and the nearest end of the body to behind the bottom of the socket, a bearing sleeve in each such opening in said blocks, each sleeve making an interference fit with the respective opening, each said pin of each said roller being rotatably disposed in each of said bearing sleeves, each bearing sleeve extending out beyond the end of the hole in the respective block toward the end of the adjacent roller to take the end thrust of the roller, each bearing sleeve having a radial flange at said end thereof that extends axially out of the hole in the respective bearing block toward the adjacent end of the respective roller, each said flange providing an axial thrust bearing for the adjacent end of the respective roller, each bearing sleeve being slotted axially, leaving a circumferential gap to allow contraction of the sleeve when positioned in the respective hole of one of said blocks, each sleeve being made of resilient material.

2. Apparatus useful in earth boring by the rotary method, comprising:

a tubular body, thread means at each end of the body for making a rotary shouldered connection with an adjacent drill string member, a plurality of circumferentially spaced, axially elongated pockets in the sides of the body, a plurality of rollers, each disposed in one of said pockets, a plurality of sockets in the sides of the body positioned one at each end of each pocket, each socket opening into the adjacent pocket, a plurality of blocks disposed one in each socket, each roller having an integral pin at each end, each pin rotatably supported in an opening in one of the blocks, each block having a front facing radially outward of said body, and a back facing radially inward and a side wall portion making an interference fit with the socket, tool cooperation means carried by the apparatus for cooperation with a tool for forcing out the blocks when it is desired to replace the rollers, said tool cooperation means comprising tool passage means, each providing an opening extending from the outer surface of said body between a socket and the nearest end of the body to behind the bottom of the socket, said sockets having arcuate side walls, each socket opening into the adjacent pocket, a portion of the side walls of each block being arcuate and generally correlative to the arcuate side wall of the block in which it is received, a portion of the side wall of each block next to the end of the adjacent pocket being flat, the arcuate portions of the side walls of said sockets being stepped, forming arcuate steps, the arcuate steps of said sockets facing outwardly toward the outer periphery of the body, the arcuate portions of the side walls of each block being stepped, providing arcuate steps, the arcuate steps of the side walls of the blocks facing inwardly toward the interior of the block, each arcuately stepped socket being adapted to receive one of said blocks by a motion of the block in a direction from outside the body going toward the interior thereof, a bearing sleeve in each said opening in said blocks, each sleeve making a resilient fit with the respective said opening, each said pin of each roller being rotatably disposed in one of said bearing sleeves, each bearing sleeve extending axially out of the hole in the respective block in which it is received toward the adjacent end of the respective roller providing an axial thrust bearing therefor, each bearing sleeve having a radial flange at said end thereof that extends axially out of the hole in the respective bearing block toward the adjacent end of the respective roller, each said flange providing said axial thrust bearing for the adjacent end of the respective roller, each bearing sleeve being slotted axially, leaving a circumferential gap to allow contraction of the sleeve when positioned in the respective hole of one of said blocks, each sleeve being made of resilient material.

3. Apparatus according to claim 2, said sleeve being slotted axially in a plurality of places about its circumference, each slot extending only part of the full length of the sleeve, alternate slots startng from opposite ends of the sleeve, the slots each extending over half the length of the sleeve.

4. Apparatus according to claim 3, there being a fillet at the end of each slot where it terminates short of the end of the sleeve.

* * * * *

UNITED STATES PATENT AND TRADEMARK OFFICE

CERTIFICATE OF CORRECTION

PATENT NO. : 4,262,760

DATED : April 21, 1981

INVENTOR(S) : Glenn L. Allison; Thomas E. Winship; Danile B. Justman

It is certified that error appears in the above—identified patent and that said Letters Patent is hereby corrected as shown below:

Column 4, line 16, change "shaft" to -shift-.

Column 4, line 45, change "alon" to -elon-.

Column 6, line 43, change "startng" to -starting-.

Signed and Sealed this

*Fourth* Day of *August 1981*

[SEAL]

*Attest:*

GERALD J. MOSSINGHOFF

*Attesting Officer*

*Commissioner of Patents and Trademarks*